US006663227B2

(12) United States Patent
Yamamoto et al.

(10) Patent No.: US 6,663,227 B2
(45) Date of Patent: Dec. 16, 2003

(54) SEMICONDUCTOR DEVICE AND PROCESS FOR PRODUCING THE SAME

(75) Inventors: Ryoichi Yamamoto, Kanagawa (JP); Masao Mitani, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 49 days.

(21) Appl. No.: 10/056,043

(22) Filed: Jan. 28, 2002

(65) Prior Publication Data

US 2002/0101483 A1 Aug. 1, 2002

(30) Foreign Application Priority Data

Jan. 26, 2001 (JP) ..... 2001-018085

(51) Int. Cl.[7] ..... B41J 2/05
(52) U.S. Cl. ..... 347/59
(58) Field of Search ..... 345/50, 58, 59; 438/694–703, 720, 722, 742; 257/48

(56) References Cited

U.S. PATENT DOCUMENTS 4,139,434 A * 2/1979 Dugan ..... 216/18
4,288,911 A * 9/1981 Ports ..... 438/17
4,429,321 A * 1/1984 Matsumoto ..... 347/59
5,063,655 A * 11/1991 Lamey et al. ..... 428/21
5,313,319 A * 5/1994 Salisbury ..... 349/40
5,434,108 A * 7/1995 Ko et al. ..... 437/228
5,739,546 A * 4/1998 Saitou et al. ..... 257/48
5,817,577 A * 10/1998 Ko ..... 438/694
6,076,912 A * 6/2000 Murthy ..... 347/18
6,217,157 B1 * 4/2001 Yoshira et al. ..... 347/65

* cited by examiner

*Primary Examiner*—Stephen D. Meier
*Assistant Examiner*—Michael S. Brooke
(74) *Attorney, Agent, or Firm*—Whitham, Curtis & Christofferson, P.C.

(57) ABSTRACT

The semiconductor device is in the form of a semiconductor chip formed as a recording head of an ink-jet printer or in the form of a semiconductor wafer having at least two semiconductor chips. The semiconductor chip has at least an ink ejection unit, an integrated circuit composed of a drive circuit for driving the ink ejection unit, bonding pads and a metal film covering at least part of an upper layer of the integrated circuit. The metal film is formed to extend from the integrated circuit to an edge of the semiconductor chip. The semiconductor wafer further has at least one grounding pad being formed of the metal film in a region peripheral to the semiconductor wafer and which is outside the semiconductor chips. The metal film is formed not only to extend from each of the integrated circuits to the edge of each of the semiconductor chips but also in a region between the semiconductor chips and the metal films formed to extend to edges of all the semiconductor chips are interconnected via the region between the semiconductor chips and also connected to the grounding pad.

15 Claims, 5 Drawing Sheets

SEMICONDUCTOR DEVICE AND PROCESS FOR PRODUCING THE SAME

BACKGROUND OF THE INVENTION

This invention relates to a semiconductor device and a process for producing the same. More particularly, it relates to the technology of semiconductor device fabrication for ensuring that elements formed in an integrated circuit on a semiconductor chip will not break down electrically due to processing steps such as sand blasting and dry etching. The semiconductor device contemplated by the invention is formed as the recording head of ink-jet printer.

A typical process for producing the recording head of a thermal ink-jet printer comprises the steps of preparing a semiconductor device by forming heaters (heat-generating resistors) and their drive circuit on a semiconductor chip (substrate), forming an ink channel and ink supply holes and forming a cavity on each heater that serves as an ink chamber, attaching an orifice plate to the entire surface of the semiconductor device, and opening ink ejection orifices (nozzles) in a position corresponding to each heater.

Conventionally, ink channels and ink supply holes are formed by anisotropic etching of a semiconductor chip with a liquid etchant such as hydrazine or potassium hydroxide (KOH), with the regions other than the ink channels and ink supply holes being masked with a photoresist. However, hydrazine is a very strong carcinogen and has a potential hazard of explosion; KOH is such a strong etchant that it can potentially strip the resist and damage the areas other than the ink channels and ink supply holes.

Alternative methods of forming ink channels and ink supply holes are laser ablation and sand blasting. In sand blasting, small-diameter particles of a blasting medium such as alumina are blown at high speed against a semiconductor device (substrate), with the regions other than ink channels and ink supply holes being masked, to form ink channels and ink supply holes simultaneously in a plurality of semiconductor chips formed on a semiconductor wafer. Sand blasting has the advantage of forming ink channels and ink supply holes in higher resolution with better efficiency than laser ablation.

However, the sand blasting process involving the blowing of small-diameter particles with dry air is not without problems. On account of the friction between the particles and the air, static electricity is generated and the resulting static buildup on the surface of the semiconductor chip can potentially break down the semiconductor device. In the case of the recording head of a thermal ink-jet printer, the drive circuit formed as an element of an integrated circuit on the semiconductor chip may break down due to static buildup during production.

Speaking further of the recording head of a thermal ink-jet printer, orifices are usually formed by dry etching an orifice plate while masking the regions other than those corresponding to the individual heaters. However, when orifices are opened by dry etching, molecules in the state of an ion plasma cause static buildup on the oxidized film formed on each heater and can potentially break down the drive circuit connected to each heater.

SUMMARY OF THE INVENTION

The present invention has been accomplished under these circumstances and has an object providing a semiconductor device furnished with a structure which ensures that elements that comprise a drive circuit for driving an ink ejection or delivery unit and which are formed in an integrated circuit on a semiconductor chip to comprise the recording head of an ink-jet printer will not break down electrically during fabrication due to processing steps such as sand blasting and dry etching.

Another object of the invention is to provide a process for producing the semiconductor device.

The first object of the invention can be attained by a semiconductor device according to its first aspect which is in the form of a semiconductor chip formed as a recording head of an ink-jet printer, the semiconductor chip comprising at least an ink ejection unit, an integrated circuit composed of a drive circuit for driving the ink ejection unit, bonding pads and a metal film covering at least part of an upper layer of the integrated circuit, the metal film being formed to extend from the integrated circuit to an edge of the semiconductor chip.

Preferably, the metal film also covers further an upper layer of at least one of the bonding pads in such a way as to extend from the bonding pad to an edge of the semiconductor chip.

According to its first aspect, the invention also provides a semiconductor device as a semiconductor wafer including at least two semiconductor chips of the structure described above and at least one grounding pad being formed of the metal film in a region peripheral to the semiconductor wafer and which is outside the semiconductor chips, wherein the metal film is also formed in a region between the semiconductor chips, and wherein the metal films formed to extend to edges of all the semiconductor chips are interconnected via the region between the semiconductor chips and also connected to the grounding pad.

Preferably, the region between the semiconductor chips is a scribing line.

In each of the embodiments described above, the ink ejection unit includes heat-generating resistors, the metal film is formed of the same material as the heat-generating resistors, and the recording head of the ink-jet printer is a recording head of a thermal ink-jet printer.

The second object of the invention can be attained by a process according to its second aspect for producing a semiconductor device in a semiconductor wafer having at least two semiconductor chips formed thereon, each serving as a recording head of an ink-jet printer, which process comprises the steps of forming at least an ink ejection unit and an integrated circuit composed of a drive circuit for driving the ink ejection unit on a semiconductor substrate for each of the semiconductor chips, covering at least part of an upper layer of the integrated circuit on each of the semiconductor chips to form metal films that each extend from the integrated circuit to an edge of each of the corresponding semiconductor chips and which are also interconnected via a region between the semiconductor chips, and also forming at least one grounding pad from the metal film in a region peripheral to the semiconductor wafer and which is outside the semiconductor chips, the grounding pad being connected to the metal film via the region between the semiconductor chips, and applying a processing step with the metal films being grounded via the grounding pad.

Preferably, the ink ejection unit includes the heat-generating resistors, the recording head of the ink-jet printer is a recording head of a thermal ink-jet printer, and the metal films are formed of the same material as the heat-generating resistors simultaneously with formation of the heat-generating resistors after forming the drive circuit.

Preferably, not only the integrated circuit but also bonding pads are further formed on the semiconductor substrate for each of the semiconductor chips, and the metal film also covers further an upper layer of at least one of the bonding pads in such a way as to extend from the bonding pad to an edge of each of the semiconductor chips.

Preferably, the processing step is either a step of forming an ink channel for supplying ink to each of the ink ejection unit or a step of boring ink supply holes through each of the semiconductor substrate for supplying ink to the ink channel or both steps.

Preferably, the region between the semiconductor chips is a scribing line.

Preferably, the metal films are also further formed on a reverse side of the semiconductor wafer which is opposite a side where the integrated circuits for the semiconductor chips are formed.

Preferably, the metal films formed on the reverse side of the semiconductor wafer cover the entire surface of the reverse side of the semiconductor wafer.

Preferably, the metal films formed on the reverse side of the semiconductor wafer are removed after finishing of the processing step.

PREFERRED EMBODIMENT OF THE INVENTION

The semiconductor device of the invention and the process for producing it are described below in detail with reference to the preferred embodiments shown in the accompanying drawings.

The recording head of a thermal ink-jet printer as an embodiment of the semiconductor device which is formed as the recording head of an ink-jet printer according to the first aspect of the invention is described below.

Figure 1:
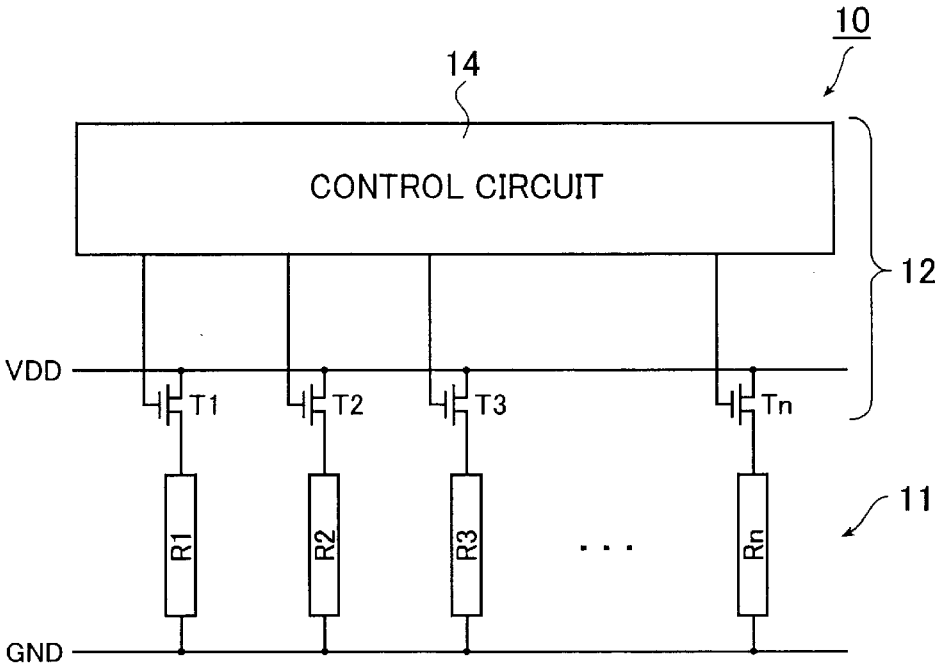
FIG. 1 shows a structural outline for the recording head of a thermal ink-jet printer which is an embodiment of the semiconductor device according to the first aspect of the invention.

FIG. 1 shows a structural outline for an embodiment of the recording head of a thermal ink-jet printer according to the first aspect of the invention. As shown, the recording head generally indicated by 10 comprises heat-generating resistors 11 (R1, R2, . . . , Rn) associated with individual orifices (nozzles) and their drive circuit 12. The orifices are recording elements that perform printing. The drive circuit 12 comprises driver transistors T1, T2, . . . Tn respectively associated with the heat-generating resistors R1, R2, . . . Rn and their control circuit 14.

The heat-generating resistors R1, R2, . . . Rn are connected at one end to a common ground GND and are connected at the other end to the sources of the associated driver transistors T1, T2, . . . Tn. The drains of the driver transistors T1, T2, . . . Tn are connected to a common power supply VDD and their gates are each supplied with a control signal from the control circuit 14. The number of the heat-generating resistors R1, R2, . . . Rn is not limited to any particular value.

In the recording head 10, the driver transistors T1, T2, . . . Tn are turned on and off under the control of the control circuit 14. If the driver transistors T1, T2, . . . Tn are turned on, an electric current flows to the associated heat-generating resistors R1, R2, . . . Rn which then generate heat. If the driver transistors T1, T2, . . . Tn are turned off, no current flows to the heat-generating resistors R1, R2, . . . Rn and they do not generate heat.

We now describe a layout of the recording head of a thermal ink-jet printer.

Figure 2:
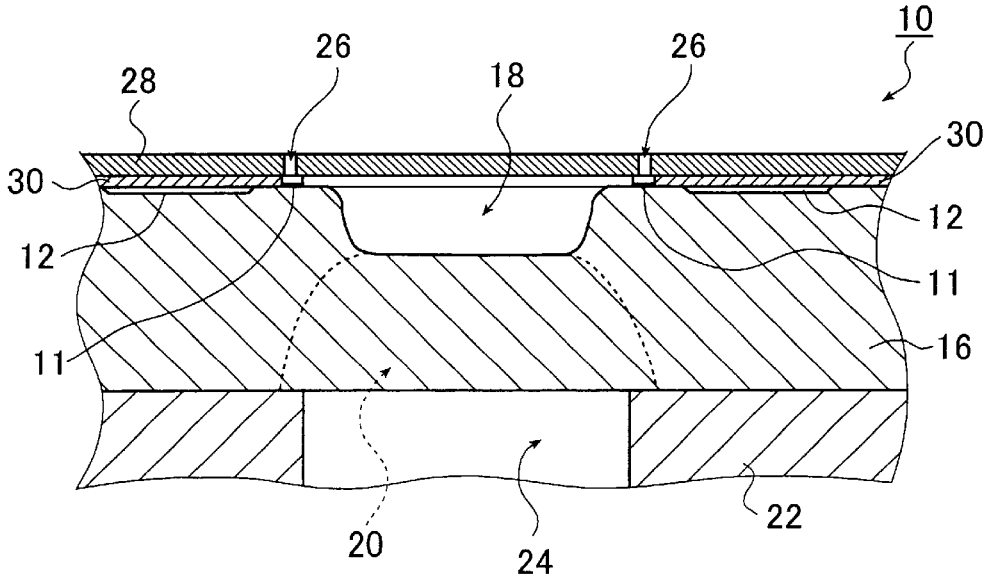
FIG. 2 is a cross-sectional layout of an embodiment of the recording head shown in FIG. 1.

FIG. 2 is a cross-sectional layout for an embodiment of the recording head shown in FIG. 1.

The recording head generally indicated by 10 in FIG. 2 is an embodiment of the semiconductor device according to the first aspect of the invention that has been produced by the semiconductor fabrication technology using the process according to the second aspect of the invention and which is used as the recording head of a thermal ink-jet printer. In the center of the region of a semiconductor chip 16 on a semiconductor substrate 15 such as a silicon substrate, an ink channel 18 through which ink is supplied to orifices is made by excavating the surface of the semiconductor substrate 15 and it extends perpendicular to the paper on which FIG. 2 is drawn.

In order to supply ink to the ink channel 18, a plurality of ink supply holes (through-holes) 20 providing communication between the back side of the semiconductor substrate 15 for the semiconductor chip 16 and the ink channel 18 are opened (bored) at given spacings in the direction in which the ink channel 18 extends. A support frame 22 is provided as a support member for proper placement of the semiconductor chip 16. Ink channels (or ink supply holes) 24 are formed in the support frame 22 to ensure that ink supplied from an ink tank (not shown) are fed via the ink supply holes 20 into the ink channel 18 formed in the obverse side of the semiconductor substrate 15 for the semiconductor chip 16.

On opposite sides of the ink channel 18, two orifice rows are formed in symmetrical positions, with each row consisting of a plurality of orifices 26 that are arranged at equal spacings along the ink channel 18. Each orifice 18 is in a hollow cylindrical form and made in an orifice plate 28 that is formed of polyimide or the like and placed on top of the semiconductor chip 16. For a resolution of 360 npi (nozzles per inch), orifices 26 are arranged perpendicular to the paper on a pitch of about 71 $\mu$m per row so that an overall resolution of 720 npi can be realized by two rows.

On top of the semiconductor substrate 15 for the semiconductor chip 16 but below the orifice rows, heat-generating resistors 11 are formed to control ink ejection or delivery from the individual orifices 26. A drive circuit 12 for driving the individual heat-generating resistors 11 is formed on the surface of the semiconductor chip 16 (semiconductor substrate 15) in areas, with the ink channel 18 lying in between, which are outside the orifice rows.

Between the surface of the semiconductor chip 16 and the orifice plate 28, there are formed partitions 30 that define an ink flow path through which ink is supplied from the ink channel 18 to each orifice 26.

Ink from the ink tank flows through the ink channel 24 in the support frame 22 to be supplied into the ink channel 18 in the surface of the semiconductor chip 16 (semiconductor substrate 15) via the ink supply holes 20 opened in the semiconductor chip 16 (semiconductor substrate 15); from the ink channel 18, the ink flows through the ink flow path defined by the partitions 30 and is distributed to the orifice rows formed on opposite sides of the ink channel 18. The individual heat-generating resistors 11 (R1, R2, . . . , Rn) are controlled by the drive circuit 12 in accordance with image data and a predetermined amount of ink is ejected or delivered from the associated orifices 26.

The semiconductor device of the invention which is to be used as the recording head of an ink-jet printer is described in greater detail with reference to FIG. 3.

Figure 3:
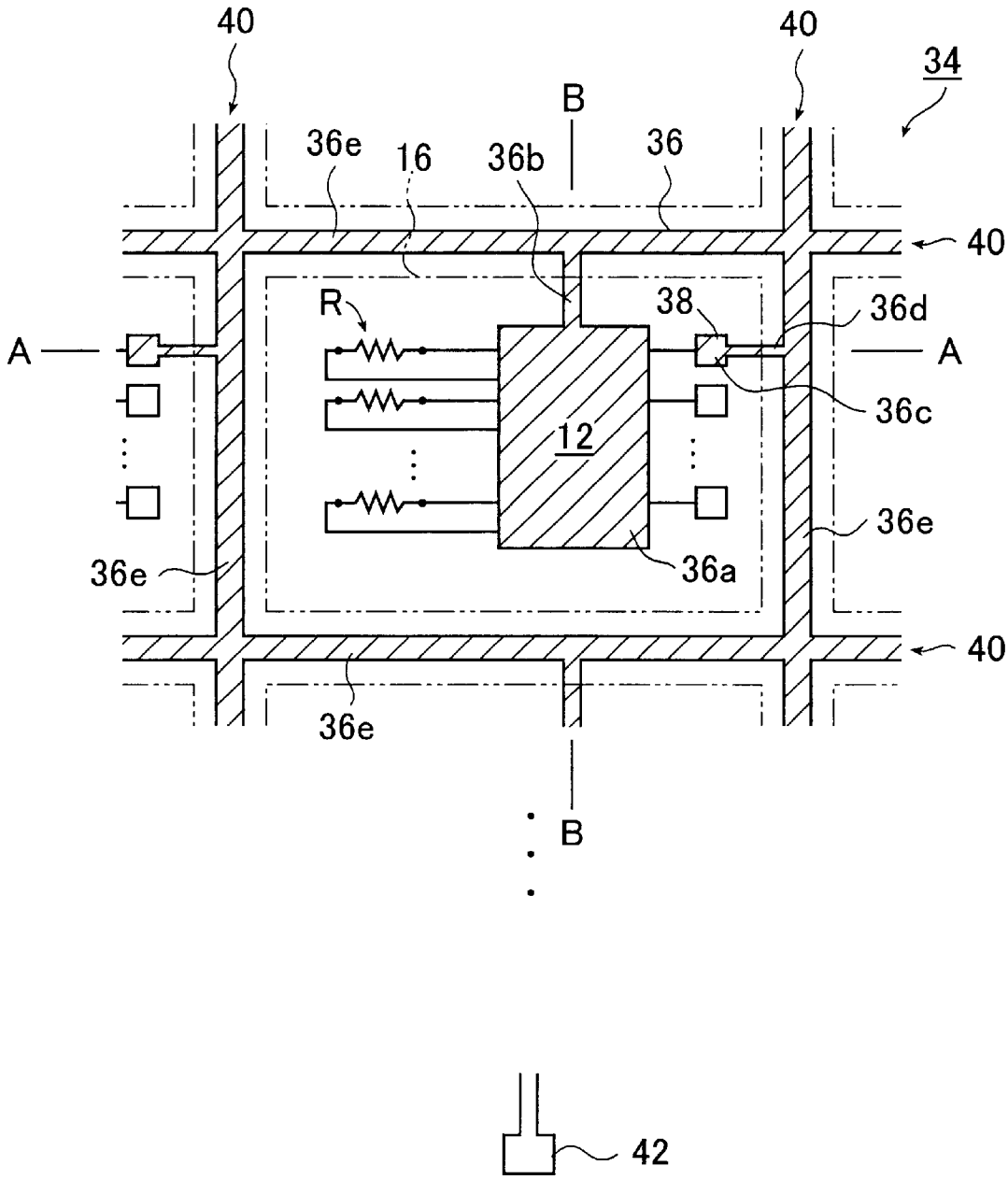
FIG. 3 is a plan view showing in conceptual form an embodiment of the semiconductor device according to the first aspect of the invention.

FIG. 3 is a plan view showing in conceptual form an embodiment of the semiconductor device according to the first aspect of the invention.

Shown conceptually in FIG. 3 is a semiconductor wafer 34 on which a plurality of semiconductor chips are formed so that each of them serves as the recording head 10 (see FIG. 2) of a thermal ink-jet printer. In FIG. 2, the recording head 10 is shown to have two orifice rows but in FIG. 3, in order to provide ease in explanation, the provision of only one orifice row is assumed as in the case of the recording head 10 shown in FIG. 1.

As shown in FIG. 3, the semiconductor device of the invention, if it is in the form of a discrete semiconductor chip, has a metal film 36 applied to an upper layer in the region of the drive circuit 12 in such a way that it extends to an edge of the semiconductor chip 16. In other words, the metal film 36 is composed of two regions 36*a* and 36*b*; the first region 36*a* covers an upper layer of the drive circuit 12 and the second region 36*b* is an extension of the region 36*a*. In the illustrated case, a metal film 36 is also applied to an upper layer of a bonding pad 38 and it similarly extends to an edge of the semiconductor chip 16. In other words, the metal film 36 also is composed of two regions 36*c* and 36*d*, the first region 36*c* covering an upper layer of the bonding pad 38 and the second region 36*d* being an extension of the region 36*c*. The metal film 36 composed of the region 36*c* which covers an upper layer of the bonding pad 38 and the region 36*d* which is extension to an edge of the semiconductor chip 16 is an optional element and more than one such metal film may be provided depending on the case.

If a plurality of semiconductor devices are to be fabricated from a semiconductor wafer 34, a metal film 36 is also applied along the region (scribing line) 40 between individual semiconductor chips 16 to form a line region 36*e* and two regions 36*b* and 36*d* of a metal film 36 which extend to an edge of every semiconductor chip 16 are interconnected by the line region 36*e* of the metal film 36 formed on each scribing line 40. A grounding pad 42, made of the same metal film, is formed in a region that is peripheral to the semiconductor wafer 34 and which is outside the individual semiconductor chips 16 and this grounding pad 42 is connected to the metal film 36 applied along the scribing lines 40.

After finishing of the fabrication process, the semiconductor chips 16 formed on the semiconductor wafer 34 are separated apart on the scribing lines 40, yielding discrete semiconductor chips 16. The metal film 36 in the line regions 36*e* formed on the scribing lines 40 in the semiconductor wafer 34 is removed when the latter is scribed into discrete semiconductor chips 16; as a result, the only metal film 36 that is left intact on each discrete semiconductor chip 16 is composed of four regions 36*a*–36*d*, the first region 36*a* covering an upper layer of the drive circuit 12, the second region 36*b* extending to an edge of the semiconductor chip 16, the third region 36*c* covering an upper layer of the bonding pad 38, and the fourth region 36*d* extending to an edge of the semiconductor chip 16.

The metal film 36 may be applied to cover the entire surface of the drive circuit 12 as indicated by 36*a* in FIG. 3. If desired, the surface of the drive circuit 12 may partly be left uncoated with the metal film 36; in this case, the drive circuit 12 is covered with the metal film 36 except in regions that are electrically sensitive to external effects such as static capacity. In each of the semiconductor chips 16, the metal film 36 covering an upper layer of the drive circuit 12 (to define the region 36*a*) and the metal film 36 covering an upper layer of the bonding pad 38 (to define the region 36*c*) may each extend to the metal film 36 formed on the scribing lines 40 (to define the line region 36*e*). Alternatively, these metal films 36 may be connected on the semiconductor chip 16 and one or more of such connected metal films may extend to the metal film 36 on the scribing lines 40.

In order to provide ease in the process to be described below for fabricating the semiconductor device, the metal film 36 may be formed of known metal compounds such as TaSiO for making the heat-generating resistors 11 with known metals such as Ni for making conductive wires with that connect the heat-generating resistors 11 to the drive circuit 12. In addition, metals such as Al, W, Ti, Mo, Ta, Pt and Au that are used in the conventional semiconductor fabrication processes and their alloys can all be employed. These metals may be used either individually or in combination; in the latter case, layers of different metals may be placed one on top of another.

In the invention, the thickness of the metal film 36 is not limited to any particular value; however, the preferred range is from 10 nm (100 Å) to 10 $\mu$m and the more preferred range is from 0.1 $\mu$m (100 nm) to 1 $\mu$m.

Needless to say, at least a certain insulation film is provided between the metal film 36 and each of the drive circuit 12 and the bonding pad 38. The insulation film may be formed of any electrical insulator and examples include those which are commonly used in semiconductor devices, such as $SiO_2$, SiN, borosilicate glass and polyimides.

Figure 4:
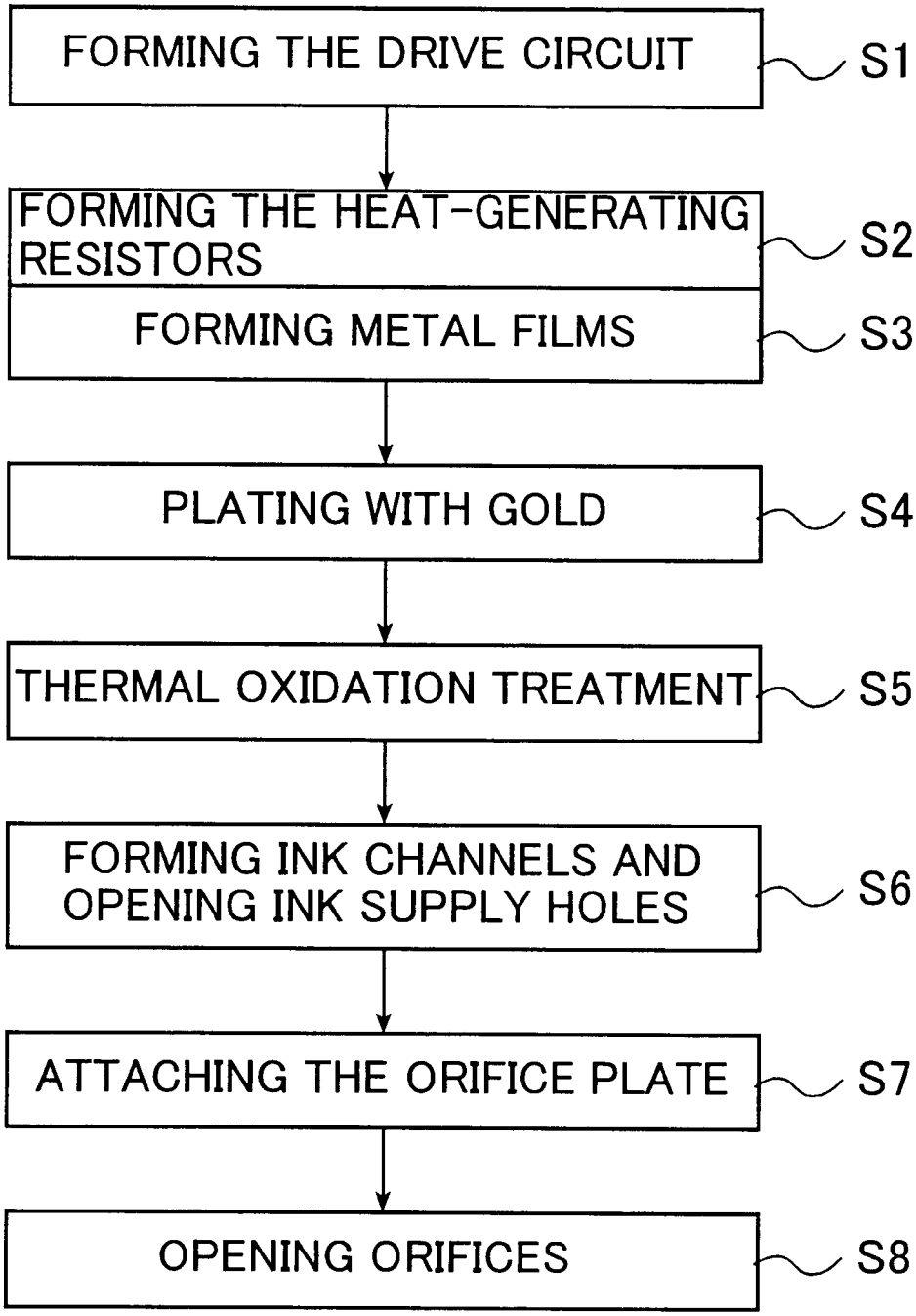
FIG. 4 is a flowchart for exemplary steps in the process for producing the semiconductor device according to the second aspect of the invention.

The process for producing the above-described semiconductor device according to the second aspect of the invention is described below with reference to the flowchart in FIG. 4 which shows the process of producing the semiconductor device as the recording head of an inkjet printer, as well as FIGS. 5A to 5D and FIGS. 6A and 6B which show steps involved in the production process. FIGS. 5A, 5B, 5C and 5D are sections A—A of the semiconductor device in the process of fabrication in steps S1, S4, S6 and S8, respectively (see the flowchart in FIG. 4), and FIGS. 6A and 6B are sections B—B of the semiconductor device in the process of fabrication in steps S1 and S3, respectively (see the flowchart in FIG. 4).

Figure 5A:
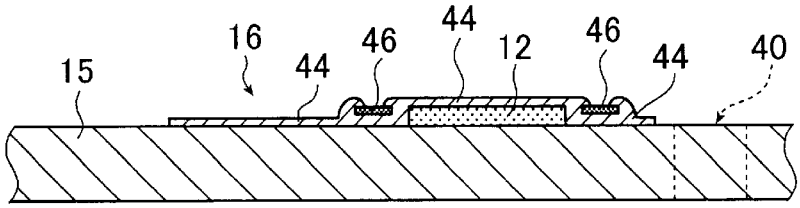
FIG. 5A to FIG. 5D are sections A—A of the semiconductor device in the process of fabrication according to the invention.
Figure 6A:
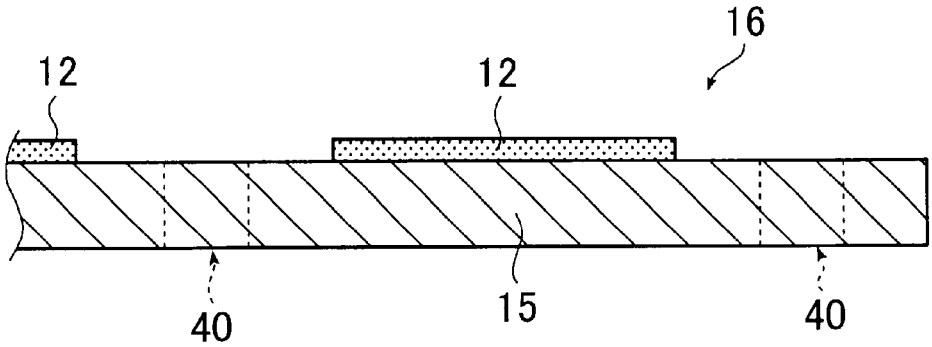
FIG. 6A and FIG. 6B are sections B—B of the semiconductor device in the process of fabrication according to the invention.
Figure 6B:
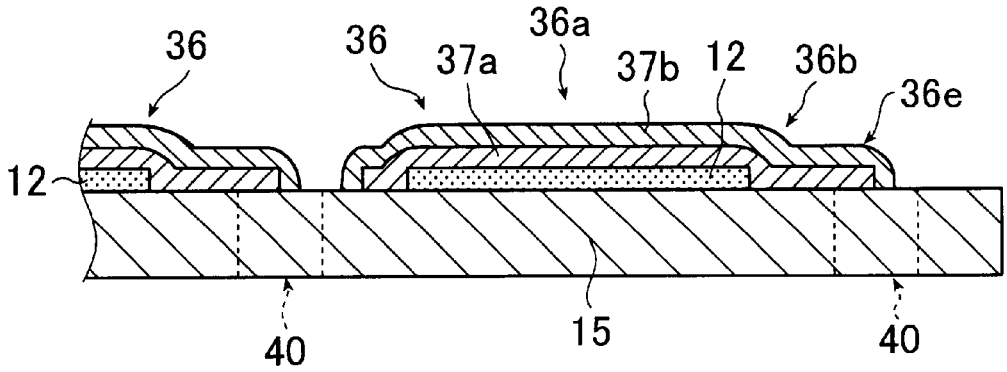

First, consider a plurality of semiconductor devices on a semiconductor wafer 34 and apply the semiconductor fabrication technology to form the drive circuit 12 in a region of each semiconductor chip 16 on the semiconductor substrate 15 as shown in FIG. 5A and FIG. 6A (step S1).

Thereafter, a protective layer 44 such as a TEOS layer for the drive circuit 12 is formed over the drive circuit 12 and its peripheral area as shown in FIG. 5A. On both sides of the drive circuit 12, a conductor such as an Al conductor 46 is formed to provide electrical connection from the drive circuit 12.

In the next step S2, heat-generating resistors 11 are formed. For instance, a two-layer metal film 36 is applied to the entire surface of the semiconductor wafer 34. This metal film is composed of a metal layer 37*a*, typically formed of TaSiO, which serves as the constituent material of the heat-generating resistors 11 and a metal layer 37*b*, typically formed of Ni, which serves as the constituent material of the conductive wire for connecting the heat-generating resistors 11 and the drive circuit 12. Then, using a heat-generating resistor forming mask, the two layers of the metal film 36 are photoetched to provide the region of heat-generating resistors 11 in which the two-layer metal film 36 has been stripped of the Ni layer 37*b* (see FIG. 5B).

In the embodiment under consideration, the double-layered metal film 36 is etched with a different mask pattern than has been used to form the heat-generating resistors 11. As a result, an upper layer of the drive circuit 12 is also covered with a two-layer metal film 36 which is made of a TaSiO layer 37*a* and a Ni layer 37*b* as in the case of the heat-generating resistors 11 but in a region independent thereof (step S3). The protective layer 44 on the topmost part of the drive circuit 12 is not shown in FIG. 6B. The metal film 36 covering an upper layer of the drive circuit 12 extends to an edge of each semiconductor chip 16 and the resulting extensions 36*b* permit all semiconductor chips 16 on the semiconductor wafer 34 to be interconnected via the scribing lines 40.

Figure 5B:
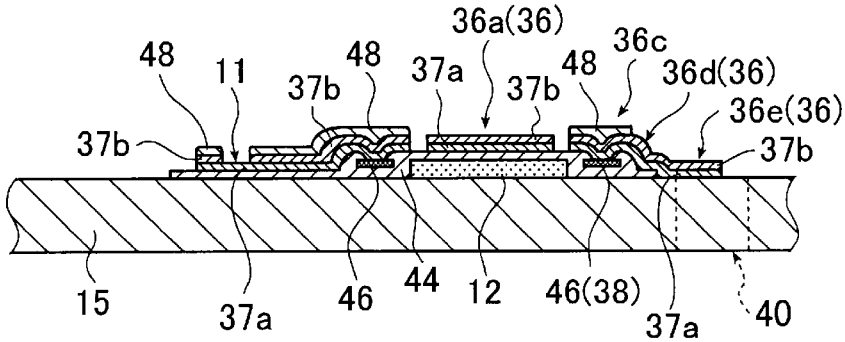

Simultaneously with the formation of the heat-generating resistors 11, an upper layer of the bonding pads 38 (Al conductors 46) formed on each semiconductor chip 16 is also covered with a double-layered metal film 36 (particularly the region 36*c*) by the same photoetching step (see FIG. 5B). In this case, at least the metal film 36 (particularly the region 36*c*) which is applied to an upper layer of the bonding pad 36 that corresponds to the ground terminal extends to an edge of the semiconductor chip 16 and the resulting extension 36*d* connects to the metal film 36 (particularly the line region 36*e*) which is applied to the scribing line 40.

In the same photoetching step, a grounding pad 42 (see FIG. 3) is formed in a region that is peripheral to the semiconductor wafer 34 and which is outside the semiconductor chips 16. The grounding pad 42 is also connected to the two-layered metal film 36 covering the scribing lines 40. The number of grounding pads 42 is not limited to any particular value as long as at least one such grounding pad is used.

Thus, by using the metal film 36 applied to form heat-generating resistors and conductors, an upper layer of the drive circuit 12, an upper layer of the bonding pads 38 and the like can be covered with the metal film 36 without increasing the number of fabrication steps involved. The constituent materials for the heat-generating resistors and conductors are not limited to those used in the embodiment described above and other materials may of course be used. If desired, the step of forming the heat-generating resistors 11 and conductors may be separate from the step of forming the metal film 36 on an upper layer of the drive circuit 12. An advantage in this case is that the heat-generating resistors and conductors can be formed of different materials from the metal film 36 on an upper layer of the drive circuit 12.

If the heat-generating resistors and conductors are to be formed of different materials than the metal film 36 on an upper layer of the drive circuit 12, the metals used in ordinary semiconductor fabrication processes such as Al, W, Ti, Mo, Ta and Pt and their alloys can all be used to make the metal film 36 covering an upper layer of the drive circuit 12 and the like. The metal film 36 may be applied to cover the entire surface of an upper layer in the drive circuit 12 or, depending on the need, its coverage may be partial.

The metal film 36 except the one applied to form the heat-generating resistors, namely, the metal film 36 which is applied to an upper layer of the drive circuit 12 and the bonding pads 38 (particularly, regions 36*a* and 36*c*), to top of the scribing lines 40 (line regions 36*e*) and to the areas spanning each of the drive circuit 12 and the bonding pads 38 and the scribing lines 40 to form extensions (regions 36*b* and 36*d*), is not limited to a double-layered film; it may be formed of a single layer or it may be formed of three or more layers. For example, the metal film 36 except the one applied to form the heat-generating resistors, namely, the metal film 36 which is applied to an upper layer of the drive circuit 12 and the bonding pads 38, to top of the scribing lines 40 and to the areas spanning each of the drive circuit 12 and the bonding pads 38 and the scribing lines 40 may be a single-layered film solely formed of TaSiO.

Subsequently, as shown in FIG. 5B, the bonding pads 38 and the grounding pad 42 for each semiconductor chip 16 are plated with gold by either electroplating or electroless plating (S4). This ensures that the bonding pads 38 and the grounding pad 42 will not be oxidized in the next thermal oxidation step but retain their conductivity. Preferably, the bonding pads 38 and the grounding pad 42 for each semiconductor chip 16 are plated with gold after masking the other regions.

If no such masking is done before gold plating, not only the metal film 36 on the bonding pads 38 and the grounding pad 42 but those on the drive circuit 12 and the scribing lines 40 also plated with gold, leading to a dramatic increase in the use of the gold plating solution. By performing the aforementioned masking, the use of the gold plating solution can be considerably reduced. If desired, the Ni conductive wire (37*b*) connecting each of the heat-generating resistors 11 and the drive circuit 12 may be plated with gold. This contributes to lowering the resistance of the conductive wire.

Subsequently, the surface of each heat-generating resistor 11 is subjected to thermal oxidation treatment (S5). As a result, an electrical insulating coat 11*a* is formed on the surface of each heat-generating resistor 11. The formed insulating coat 11*a* has very high strength and is resistant to the corrosive action of ink. Hence, the protective film which is required by the recording head of the conventional thermal ink-jet printer in order to provide resistance against cavitation and corrosion can be dispensed with, reducing the energy input and the like and realizing a recording head that is compact and which still has high thermal efficiency.

Figure 5C:
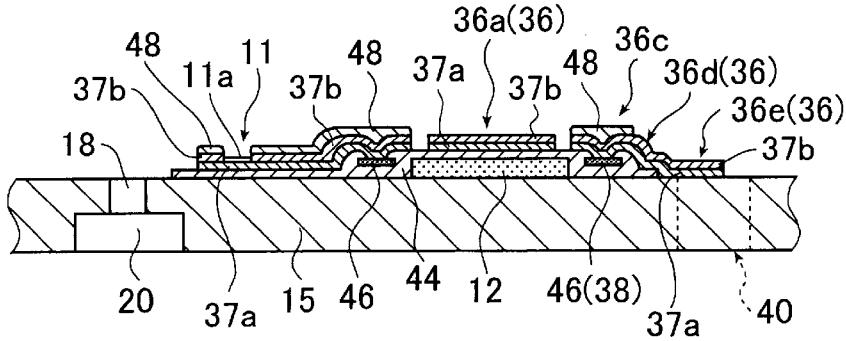

Subsequently, as shown in FIG. 5C, those regions of the semiconductor substrate 15 for the semiconductor chip 16 in which ink supply holes 20 are to be formed are excavated by sand blasting the obverse and/or reverse side of the semiconductor wafer 34 (particularly, the semiconductor substrate 15) not only to form an ink channel 18 but also to open (bore) ink supply holes 20 through each semiconductor chip 16 (particularly, its semiconductor substrate 15) (S6).

Figure 5D:
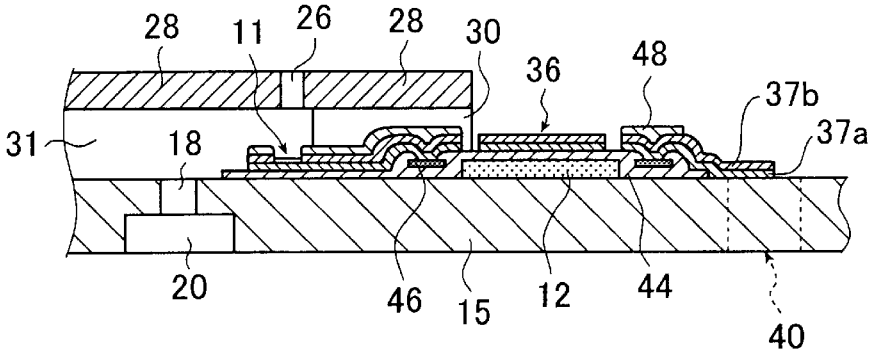

After these processing steps, as shown in FIG. 5D, partitions 30 are formed on the surface of the semiconductor chip 16 to define cavities over the heat-generating resistors 11 that serve as ink chambers 31; then, the orifice plate 28 is attached to the surface of the semiconductor wafer 34 (or the semiconductor chip 16) (S7) and orifices 26 are opened (bored) by dry etching (S8).

In the invention, when processing steps are performed as by sand blasting to form the ink channel 18 and open the ink supply holes 20 and by dry etching to open the orifices 26, the metal film 36 applied to cover an upper layer in each of the drive circuits 12, bonding pads 38 and the grounding pads 42 is grounded electrically via the grounding pad 42 on the semiconductor wafer 34 so as to guide electric charges into the ground. This is effective in preventing electrical breakdown of the drive circuits 12 in the invention.

Described above are the basic construction of the semiconductor device of the invention and the process for producing the same.

Figure 7:
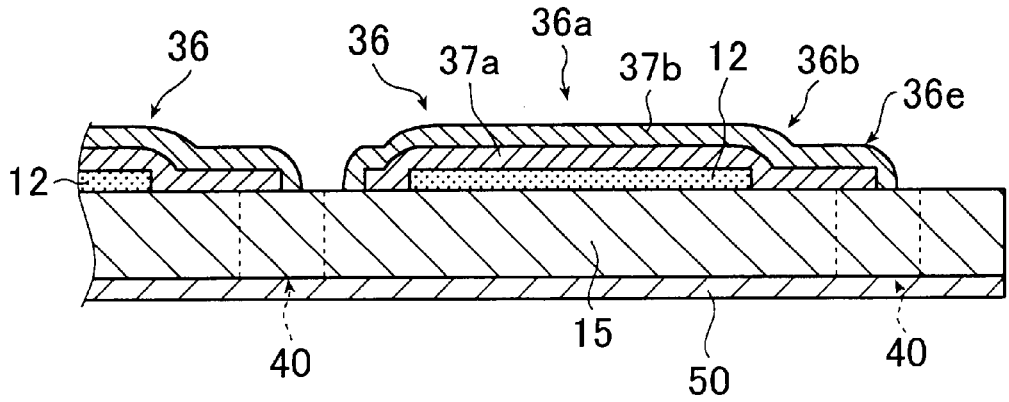
FIG. 7 is a section of the semiconductor device in the process of fabrication by another example of the invention process.

In the process of the invention for producing the semiconductor device, the metal film 36 is provided on the surface of the semiconductor wafer 34 where the drive circuit 12 is formed on each semiconductor chip 16 and its provision is effected prior to processing steps such as sand blasting to form the ink channel 18 and open the ink supply holes 20 and dry etching to open the orifices 26. This is not the sole case of the invention and, as shown in FIG. 7, a metal film 50 is preferably provided on the reverse side of the semiconductor wafer 34 (particularly, its semiconductor substrate 15) in addition to the metal film 36 on the obverse side. The metal film 50 to be provided on the reverse side of the semiconductor wafer 34 may be of the same or different composition than the metal film 36.

If the metal film 50 is to be provided, it preferably covers the entire surface of the reverse side of the semiconductor wafer 34 (semiconductor substrate 15).

After the metal films 36 and 50 are thusly formed on the obverse and reverse sides, respectively, of the semiconductor wafer 34 with drive circuits 12 on it, processing steps are conducted as by sand blasting to form the ink channels 18 and bore the ink supply holes 20 and by dry etching to open the orifices 26. Even if static electricity is generated during these processing steps, the resulting electric charges can be flowed into the ground more effectively than when only one surface of the semiconductor wafer 34 is covered with the metal film 36 and, hence, the drive circuit 12 can more positively be protected against breakdown due to static charge-up.

After forming the ink channels 18, ink supply holes 20 and orifices 26 by the processing steps, the metal film 50 formed on the reverse side of the semiconductor wafer 34 is preferably removed by a suitable method such as dry or wet etching. Needless to say, the unwanted areas of the metal film 36 on the obverse side of the semiconductor wafer 34 may also be etched away or otherwise removed after the processing steps.

To perform processing steps such as excavation and boring of the semiconductor substrate 15 for the semiconductor chip 16, holes may be opened through it from one side, i.e., either the obverse or reverse side. If desired, holes may be opened simultaneously from both sides of the semiconductor chip 16; alternatively, holes may first be opened from either one side of the semiconductor chip 16 to an intermediate depth and then holes are opened into the other side of the semiconductor chip 16 until it is tunneled through.

The invention is applicable to the recording heads of both monochromatic and full-color thermal ink-jet printers which employ semiconductor devices. While various constructions are known for the recording heads including the top shooter type (face ink-jet) and the side shooter type (edge ink-jet), all of them can be used in the invention. Orifices can be arranged in any desired number of rows and there is no limitation on the number of recording elements that can be provided.

In the embodiments described above, the semiconductor device of the invention is used with the recording head of a thermal ink-jet printer which ejects ink upon heating. However, this is not the sole case of the invention and the claimed semiconductor device is applicable to all other known types of ink-jet printer including the pressure type which ejects ink by vibrating the diaphragm with the aid of a piezoelectric device or under static electric force. In the invention, the heat-generating resistors used in the thermal type as well as the piezoelectric device and the like that are used in the pressure type are collectively referred to as the ink ejection or delivery unit.

It should also be noted that the applicability of the invention is not limited to the recording head of a thermal ink-jet printer but that it is also applicable to semiconductor devices of such a type that the elements of an IC circuit formed on a semiconductor chip may potentially experience electrical breakdown due to processing steps performed in the fabrication process.

While the semiconductor device of the invention and the process for its production have been described above in detail with reference to various embodiments, it goes without saying that the invention is by no means limited to the foregoing embodiments and various improvements and modifications can be made without departing from the spirit and scope of the invention.

As described above in detail, the invention is characterized in that the metal film formed on an upper layer of each of the IC circuits and bonding pads is grounded via the grounding pad formed on the semiconductor wafer before the latter is processed to fabricate semiconductor devices.

As a result, the elements of the IC circuit in each semiconductor device can be prevented from undergoing electric breakdown due to processing steps such as sand blasting and dry etching and this offers the advantage of improving the production yield for semiconductor devices.

What is claimed is:

1. A semiconductor device as a semiconductor chip formed as a recording head of an ink-jet printer, said semiconductor chip comprising at least an ink ejection unit, an integrated circuit comprising a drive circuit for driving the ink ejection unit, bonding pads and a metal film covering at least part of an upper layer of said integrated circuit, said metal film being formed to extend from said integrated circuit to an edge of said semiconductor chip and to be electrically insulated from said integrated circuit.

2. The semiconductor device according to claim 1, wherein said metal film also covers further an upper layer of at least one of said bonding pads in such a way as to extend from said bonding pad to an edge of said semiconductor chip.

3. The semiconductor device according to claim 1, wherein said ink ejection unit includes heat-generating resistors, said metal film is formed of the same material as said heat-generating resistors, and said recording head of said ink-jet printer is a recording head of a thermal ink-jet printer.

4. A semiconductor device as a semiconductor wafer including:

at least two semiconductor chips, each semiconductor chip being formed as a recording head of an ink-jet printer and having at least an ink ejection unit, an integrated circuit comprising a drive circuit for driving the ink ejection unit, bonding pads and a metal film covering at least one part of an upper layer of said integrated circuit; and at least one grounding pad being formed of said metal film in a peripheral region of said semiconductor wafer and which is outside said semiconductor chips;

wherein said metal film is formed not only to extend from each of said integrated circuits to an edge of each of said semiconductor chips but also in a region between said semiconductor chips, and wherein the metal film is formed to extend to the edges of all semiconductor chips are interconnected via the region between said semiconductor chips and also connected to said grounding pad.

5. The semiconductor device according to claim 4, wherein said metal film also covers further an upper layer of at least one of said bonding pads in such a way as to extend from said bonding pad to an edge of each of said semiconductor chips.

6. The semiconductor device according to claim 4, wherein the region between said semiconductor chips is a scribing line.

7. The semiconductor device according to claim 4, wherein said ink ejection unit includes heat-generating resistors, said metal film is formed of the same material as said heat-generating resistors, and said recording head of said ink-jet printer is a recording head of a thermal ink-jet printer.

8. A process for producing a semiconductor device in a semiconductor wafer having at least two semiconductor chips formed thereon, each serving as a recording head of an ink-jet printer, comprising the steps of: forming at least an ink ejection unit and an integrated circuit composed of a drive circuit for driving the ink ejection unit on a semiconductor substrate for each of said semiconductor chips; covering at least part of an upper layer of the integrated circuit on each of said semiconductor chips to form metal films that each extend from said integrated circuit to an edge of each of said corresponding semiconductor chips and which are also interconnected via region between said semiconductor chips, and also forming at least one grounding pad from said metal film in a region peripheral to said semiconductor wafer and which is outside said semiconductor chips, said grounding pad being connected to said metal film via the region between said semiconductor chips; and applying a processing step with said metal films being grounded via said grounding pad.

9. The process for producing the semiconductor device according to claim 8, wherein said ink ejection unit includes said heat-generating resistors, said recording head of said ink-jet printer is a recording head of a thermal ink-jet printer, and said metal films are formed of the same material as said heat-generating resistors simultaneously with formation of said heat-generating resistors after forming said drive circuit.

10. The process for producing the semiconductor device according to claim 8, wherein not only said integrated circuit but also bonding pads are further formed on the semiconductor substrate for each of said semiconductor chips, and wherein said metal film also covers further an upper layer of at least one of said bonding pads in such a way as to extend from said bonding pad to an edge of each of said semiconductor chips.

11. The process for producing the semiconductor device according to claim 8, wherein said processing step is either a step of forming an ink channel for supplying ink to each of said ink ejection unit or a step of boring ink supply holes through said semiconductor substrate for supplying ink to the ink channel or both steps.

12. The process for producing the semiconductor device according to claim 8, wherein said region between said semiconductor chips is a scribing line.

13. The process for producing the semiconductor device according to claim 8, wherein said metal films are also formed on a reverse side of said semiconductor wafer which is opposite a side where said integrated circuits for said semiconductor chips are formed.

14. The process for producing the semiconductor device according to claim 13, wherein said metal films formed on the reverse side of said semiconductor wafer cover the entire surface of the reverse side of said semiconductor wafer.

15. The process for producing the semiconductor device according to claim 13, wherein said metal films formed on the reverse side of said semiconductor wafer are removed after finishing said processing step.

* * * * *